US009919347B2

(12) United States Patent
Haworth et al.

(10) Patent No.: US 9,919,347 B2
(45) Date of Patent: Mar. 20, 2018

(54) FOAM GENERATING SPRAY DEVICE AND SPRAY HEAD FOR USE THEREIN

(71) Applicant: TETROSYL LIMITED, Walmersley (GB)

(72) Inventors: Stuart Hyram Haworth, Walmersley (GB); Anthony Dymond, Walmersley (GB)

(73) Assignee: Tetrosyl Limited, Bury (GB)

( * ) Notice: Subject to any disclaimer, the term of this patent is extended or adjusted under 35 U.S.C. 154(b) by 68 days.

(21) Appl. No.: 14/824,140

(22) Filed: Aug. 12, 2015

(65) Prior Publication Data

US 2015/0375271 A1 Dec. 31, 2015

Related U.S. Application Data

(63) Continuation of application No. PCT/GB2014/050415, filed on Feb. 12, 2014.

(30) Foreign Application Priority Data

Feb. 12, 2013 (GB) ..... 1302449.2
Feb. 12, 2013 (GB) ..... 1302455.9

(51) Int. Cl.
*B08B 3/02* (2006.01)
*B05B 7/00* (2006.01)
(Continued)

(52) U.S. Cl.
CPC ..... *B08B 3/02* (2013.01); *B05B 7/005* (2013.01); *B05B 7/0062* (2013.01); *B05B 7/2443* (2013.01); *B05B 15/005* (2013.01)

(58) Field of Classification Search
CPC ..... B05B 1/34; B05B 7/0002; B05B 7/0056; B05B 7/005; B05B 7/0068; B05B 7/0408;
(Continued)

(56) References Cited

U.S. PATENT DOCUMENTS 2,310,633 A * 2/1943 Heimburger ..... B05B 7/2424 239/335
2,965,309 A * 12/1960 Parrott ..... A01C 23/042 239/310
(Continued)

FOREIGN PATENT DOCUMENTS

CN 1090796 A 8/1994
CN 2411939 Y 12/2000
(Continued)

OTHER PUBLICATIONS

English Translation of CN 1 090 796 A.
(Continued)

*Primary Examiner* — Arthur O. Hall
*Assistant Examiner* — Cody Lieuwen
(74) *Attorney, Agent, or Firm* — Woodard, Emhardt, Moriarty, McNett & Henry LLP

(57) ABSTRACT

A spray device comprises a container for detergent, a spray head for mounting on the container, and a liquid supply for transferring liquid from the container to the spray head. The spray head comprises: a body, a chamber in communication with the atmosphere, an elongate outlet bore extending to an outlet of the body, a detergent inlet aperture in a surface of the chamber, communicating with the liquid supply for communication with the interior of the container, and a water inlet for the chamber. The water inlet is configured to direct a jet of water over the detergent inlet aperture towards the outlet bore. Passage of the water jet over the inlet aperture causes detergent from the container to be drawn into the chamber. The inner surface of the foam generating outlet bore is formed as an aerating surface. Spray heads for use with such spray devices are also disclosed.

21 Claims, 8 Drawing Sheets

(51) Int. Cl.
*B05B 7/24* (2006.01)
*B05B 15/00* (2006.01)

(58) Field of Classification Search
CPC ... B05B 7/0425; B05B 7/2424; B05B 7/2443; B05B 15/005; B05B 7/244; B08B 3/02; B08B 3/026; B08B 3/028
USPC .... 239/311, 318, 335, 343, 370, 428.5, 433, 239/434, 310, DIG. 23
See application file for complete search history.

(56) References Cited

U.S. PATENT DOCUMENTS 3,547,709 A 12/1970 Petit et al.
4,207,202 A * 6/1980 Cole, Jr. ..... B01F 5/061 261/28
5,383,603 A 1/1995 Englhard et al.
5,445,226 A * 8/1995 Scott ..... B05B 7/0056 169/15
6,578,776 B1 6/2003 Shanklin et al.
2002/0070246 A1* 6/2002 Barriac ..... B05B 9/0426 222/382
2005/0184171 A1* 8/2005 Shanklin ..... B05B 7/2443 239/310
2006/0226259 A1* 10/2006 Lund ..... B05B 1/005 239/398
2007/0267519 A1* 11/2007 Laible ..... A62C 13/76 239/310

FOREIGN PATENT DOCUMENTS

CN 201353544 Y 12/2009
EP 1 205 253 A2 5/2002
GB 2 316 893 A 3/1998
GB 2316893 A * 3/1998 ..... B05B 1/1609
WO WO 01/30507 A1 5/2001

OTHER PUBLICATIONS

English translation of CN 2 411 939 Y.
English Translation of CN 201 353 544 Y.
First Office Action in related CN 2014800085239 dated Dec. 2, 2016.
International Preliminary Report and Written Opinion of the Inernational Searcing Authority dated Feb. 12, 2013.

* cited by examiner

FOAM GENERATING SPRAY DEVICE AND SPRAY HEAD FOR USE THEREIN

The present invention relates to a foam generating spray device. The invention relates more particularly to a foam generating spray device intended for use in producing so-called "snow-foam". The invention also relates to a foam generating spray head for use in such device.

Snow-foam is a relatively thick, liquid foam which, as its name suggests, is white and which has special application for the cleaning of cars and other vehicles. Snow foam is applied to the vehicle surface as a cleaning agent for use during the main washing operation. Due to its relatively thick nature, the snow foam clings to the vehicle surface and serves to lift and loosen dirt, grime etc. from the body surface (with mechanical agitation using a wash sponge). Subsequently, the snow foam is washed from the vehicle using a copious supply of water, taking with it the lifted dirt, grime etc.

At present, generation of snow foam requires high pressure water. As such, snow foam is mainly used in commercial vehicle washing installations e.g., (so called "car-washes") which have the necessary apparatus for generating high pressure water streams for admixture with a detergent concentrate to produce the snow foam for application to a vehicle.

Apparatus for generating snow foam for domestic use is also available. However such systems (e.g., as available from Karcher) do still require an arrangement for generating a high pressure water flow for mixture with the detergent solution to produce the snow foam. The means required for generating the high pressure water flow adds considerably to the cost of the apparatus, and as a result snow foam generating apparatus for domestic use is relatively expensive.

Therefore, at present, a person who wishes to use snow foam as a pre-wash for cleaning their vehicle effectively only has the choice of travelling to a car-wash or making a relatively expensive purchase of equipment for domestic use.

There will be a considerable advantage if it were possible to generate snow foam from a water supply at normal mains pressure. The present invention is addressed to this need.

According to a first aspect of the present invention there is provided a spray device comprising a container for holding detergent, a spray head for mounting on the container, and a liquid supply arrangement for transferring liquid from the container to the spray head, wherein the spray head comprises:

- a body,
- a chamber formed in the body and being in communication with the atmosphere,
- an elongate foam generating outlet bore formed in the body and extending in a first direction from the chamber to an outlet of the body,
- a detergent inlet aperture in a surface of the chamber, said inlet aperture communicating with the liquid supply arrangement and being for communication with the interior of the container,
- a water inlet for the chamber and being configured to direct a jet of water over said detergent inlet aperture and into the chamber in said first direction towards the foam generating chamber, said water inlet and said detergent inlet aperture being co-configured so that passage of said water jet over said inlet aperture causes detergent from the container to be drawn into the mixing chamber,

- and wherein the inner surface of the foam generating outlet bore is formed as an aerating surface.

According to a second aspect of the present invention there is provided a foam generating spray head comprising:

- a body,
- a chamber formed in the body and being in communication with the atmosphere,
- an elongate foam generating outlet bore formed in the body and extending in a first direction from the chamber to an outlet of the body,
- a detergent inlet aperture in a surface of the chamber, said inlet aperture being for communication with a reservoir of detergent,
- a water inlet for the chamber and being configured to direct a jet of water over said detergent inlet aperture and into the chamber in said first direction towards the foam generating chamber, said water inlet and said detergent inlet aperture being co-configured so that passage of said water jet over said inlet aperture causes detergent from the reservoir to be drawn into the mixing chamber,
- wherein the inner surface of the foam generating outlet bore is formed as an aerating surface.

We have found, in accordance with the invention, that snow foam may be generated from water at normal mains pressure by means of a spray head which incorporates, firstly, a mixing arrangement whereby an incoming water stream causes detergent to be drawn into the spray head for mixture with the water, and secondly an outlet bore with an inner surface configured as an aeration surface to introduce air into the detergent water mixture to produce snow foam. More particularly, the mixing arrangement is such that an inlet water jet passes over the detergent inlet aperture to generate a venturi effect that causes detergent solution to be drawn (from a container on which the spray head is mounted) into the spray head for mixture with the water. The continuing passage of water through the head causes the mixture to pass into the outlet bore where the aforementioned aerating surface introduces air into the mixture to produce the snow foam which is projected as a jet from the outlet of the body. The aeration surface may be formed in various ways (see below) but should be one which does not provide any significant interruption in at least the central region of the bore, since such interruption can adversely affect production of the snow foam and/or its projection from the spray head. Preferably, the bore is uninterrupted along its length and across the major part of its cross-sectional area, save for the provision of the aeration surface. Put another way, the bore is preferably uninterrupted along its length at regions between the aeration surface and the centre line of the bore.

The aerating surface of the outlet bore may be provided by virtue of the bore (which is preferably cylindrical) being lined at least partly with a mesh structure, preferably one that is tubular (most preferably cylindrical). More particularly, the bore is lined along its length and around its periphery with the mesh structure. The mesh structure may be tubular (most preferably of circular cross-section). The mesh may be metallic and may for example have diamond-shaped apertures which measure about 1.5 mm across their diagonals. The mesh structure may be of an expanded metal. Such an expanded metal may be formed from a sheet of aluminium or other metal which has been perforated and expanded to form a lattice ("mesh") structure, e.g., one with diamond shaped openings. It is particularly preferred that the mesh structure is a double-walled structure. Such a structure may be formed by spirally winding a mesh sheet.

Whilst a double-walled mesh structure is preferred, it is however also possible to use such a structure having only a single wall or three or more walls. Additionally, other forms of aerating surface are possible. Thus, for example, the outlet bore of the spray head may comprise particulate material projecting from its surface. Such particulate material may be abrasive.

In a particularly preferred embodiment of the invention, the surface of the chamber in which the detergent inlet aperture is provided has a configuration that causes a diverging flow of detergent into the chamber towards the foam generating outlet bore. Such a configuration may be provided by a recess (e.g., generally triangular) having two sides diverging from the detergent inlet aperture towards the foam generating outlet bore.

It is also preferred that the surface of the chamber in which the detergent inlet aperture is provided is inclined such that a notional line drawn through the centre of the water inlet and extending in the first direction (i.e., the direction in which the outlet bore extends) meets the surface of the chamber in which the detergent inlet aperture is provided at a point downstream of that aperture.

Preferably also a downstream region of the chamber is in the form of a passageway (e.g., a "tunnel") that converges towards the outlet bore. At its junction with the upstream end of the outlet bore, the downstream end of the chamber is preferably of smaller cross-section than the outlet bore so there can be some expansion of the water/detergent mixture as it enters the bore. Preferably the increase in cross-section in going from the downstream end of the chamber to the upstream end of the bore is in the form of a step.

The spray head may be formed with a connector onto which a hose of standard dimensions may be. Such a hose will usually be of somewhat larger cross-section than the diameter of the water inlet to the chamber. Therefore, the incoming water stream may be passed along a converging pathway so that the water flow is reduced to the required cross section (and its velocity increased) to issue from the water inlet to the chamber as a fine jet capable of generating a venturi effect to cause detergent to be drawn into the spray head.

A further preferred feature of the spray head is that it is provided with a valve that may be operated so as selectively to allow or prevent communication between the spray head and the detergent formulation from which the snow foam is to be generated. With the valve in an open position, snow foam may be generated by the procedure described above. With the valve in the closed position, a stream of only water issues from the spray head. It will therefore be appreciated that, with the valve in the open position, snow foam is generated and may be applied to a vehicle being cleaned. Once sufficient snow foam has been applied to the vehicle, the valve may be closed and a stream of water used for rinsing the snow foam (with lifted dirt, grime etc.) from the vehicle.

The liquid supply arrangement of the spray device may be a dip tube arrangement. Preferably, the outlet of the container accommodates a bung having a bore and the dip tube arrangement comprises a first dip tube extending from the bore downwardly into the container and a second dip tube extending between the bore and the spray head. The spray head may be fixed to the second dip tube.

The container of the spray device may have a side wall formed with a recess in which the spray head may be located. The spray device may be supplied to a customer as a package comprising packaging material and a spray device in said package with the spray head being located in said recess. Alternatively, the device may be supplied to the customer with the spray head already mounted on the container.

The snow foam concentrate that is provided in the container (for generation of snow foam by admixture with water in the manner described more fully above) may for example comprise:

| | |
|---|---|
| Amine salt of dodecyl benzene sulphonate | (25-35% by weight) |
| Coconut diethanolamide | (40-60% by weight) |
| Sodium Lauryl ether sulphate | (15-25% by weight) |

The invention will be further described, by way of example only, with reference to the accompanying drawings, in which.

Figure 1:
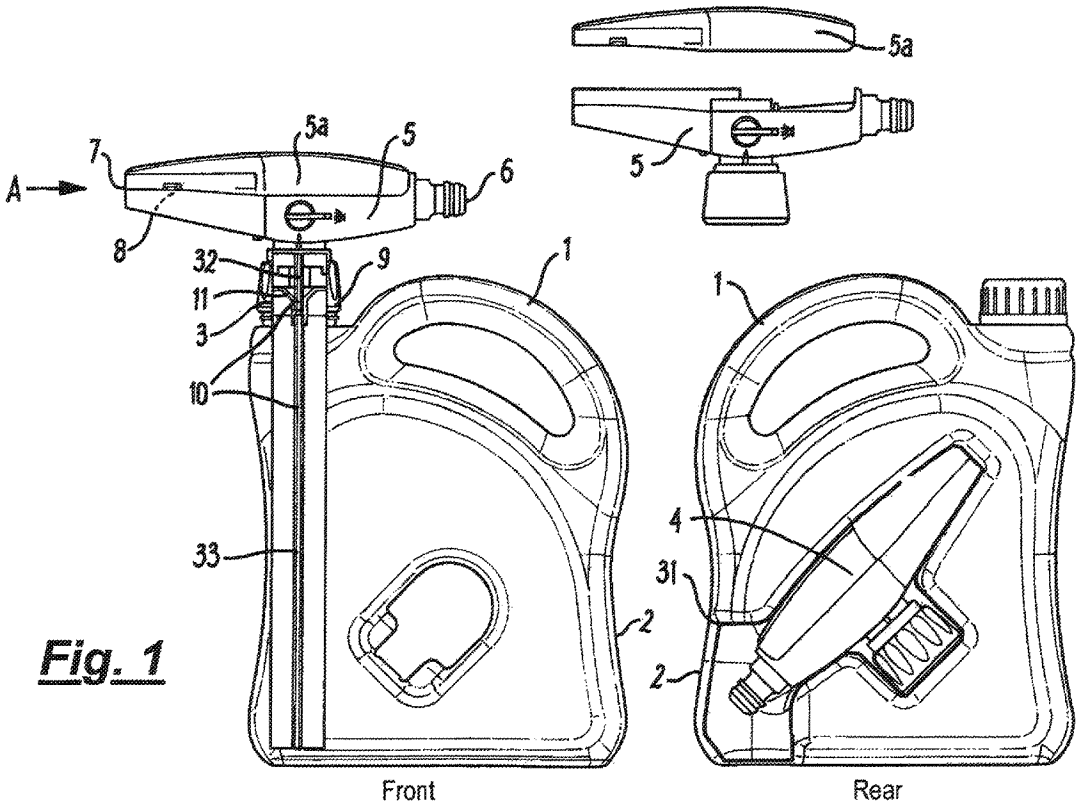
FIG. 1 shows schematic front and rear views of one embodiment of sprayer device in accordance with the invention together with an exploded view of the spray head.

FIG. 1 illustrates a sprayer device 1 in accordance with the invention and a fuller description is given below. In the following description, references to "horizontal" and "vertical" on relation to the sprayer device in the attitude as shown in FIG. 1. Thus, "horizontal" refers to the "left-right" direction in the plane of the paper and also the direction perpendicular thereto into and out of the plane of the paper. The term "vertical" refers to the "up-down" direction in the plane of the paper.

Figure 2:
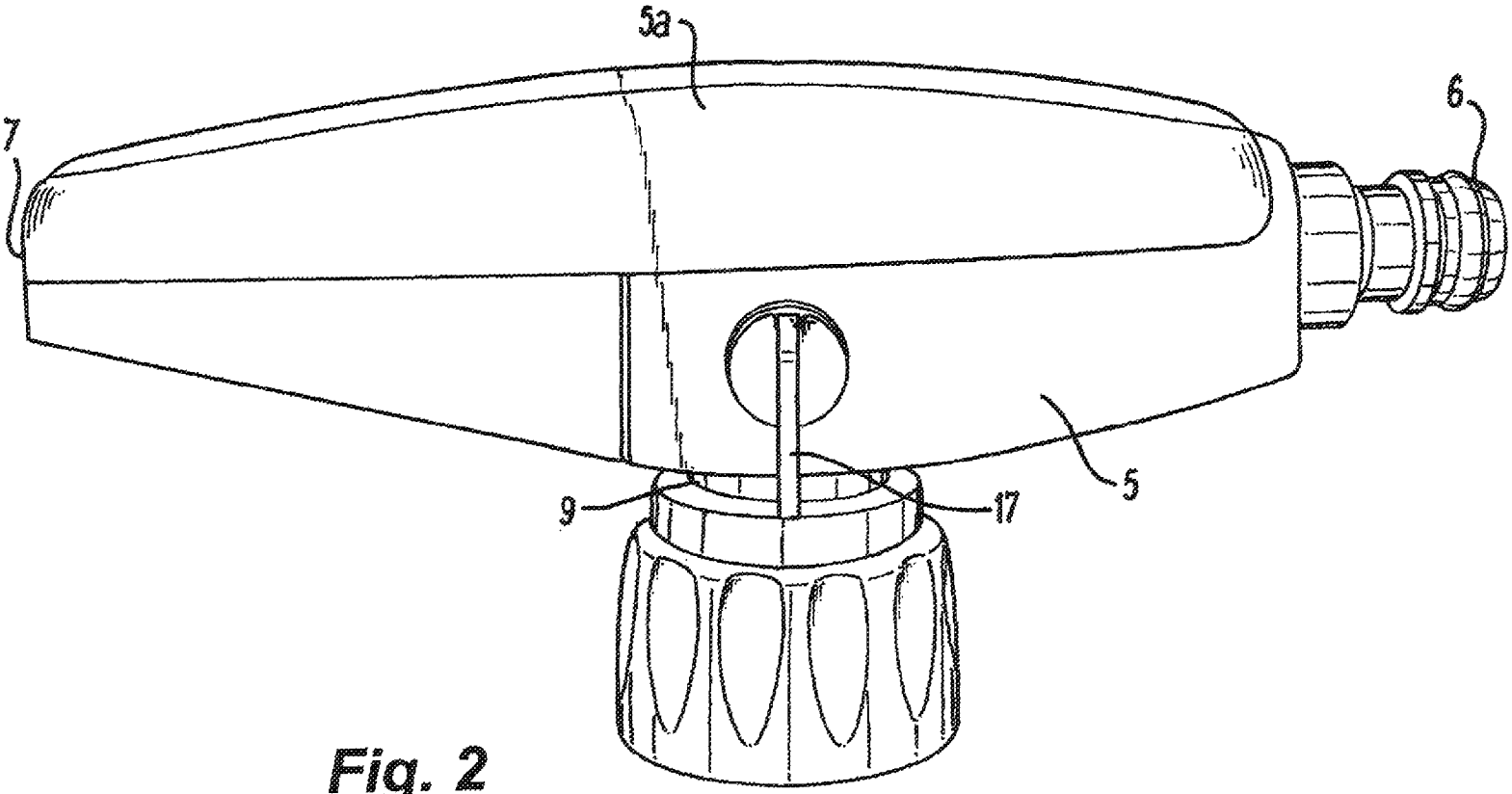
FIG. 2 is a side view, to an enlarged scale, of the spray head incorporated in the device of FIG. 1.

As shown in FIG. 1, a sprayer device 1 in accordance with the invention comprises a moulded plastics container 2 on which, mounted on an externally screw-threaded neck 3 thereof, is a spray head 4 in accordance with the invention, the latter also being shown in the enlarged view of FIG. 2. This spray head 4 has a generally elongate body 5, at one end of which (the right hand end as seen in FIG. 1) is a hose connector 6 and at the other end of which (the left hand end as seen in FIG. 1) is a foam outlet 7 at the downstream end of an outlet bore 8 that extends longitudinally within the elongate body 5. Additionally, spray head 4 is provided (in its lower region) with an internally screw threaded boss 9 by means of which the head 4 is located on the screw-threaded neck 3 of container 1. Further features of the spray device 1 shown in FIG. 1 are a dip tube arrangement 10 and an apertured bung 11 located in the neck 3 of container 1. The dip tube arrangement 10 extends downwardly from a central region of the spray head 4 through the aperture in the bung 11 and down to the bottom of container 2 which (in use of the spray device 1) contains a surfactant composition suitable for use in generation of snow foam by operation of the spray device 1.

Figure 3:
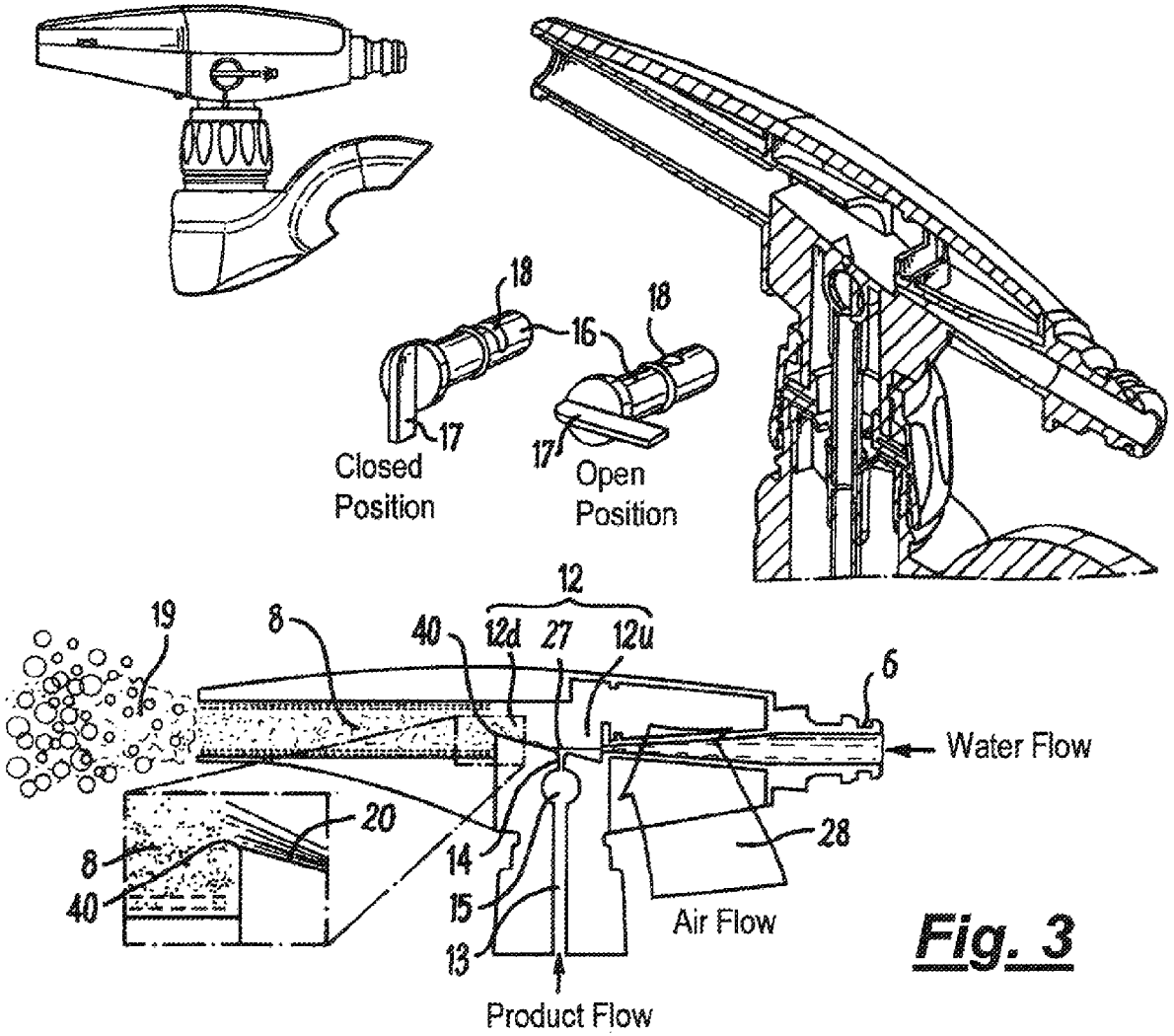
FIG. 3 illustrates details of the spray head illustrated in FIG. 2 and its use in the production of snow-foam.

Referring now to FIG. 3, it will be seen that the body 5 of spray head 4 is formed internally with an upstream chamber 12*u* and downstream chamber 12*d*, collectively referred to as chamber 12. As described more fully below, this chamber 12 communicates with hose connector 6, with the outlet bore 8 and also with the interior of container 2. For this latter purpose, head 4 is formed internally with a passageway 13 and an aligned, smaller cross-section passageway 14 between the adjacent ends of which is a transverse, circular section bore 15 formed in the body 5. Passageway 13 leads from the dip tube arrangement 10 and extends to provide an inlet to the bore 15. Passageway 14 provides an outlet for the bore 15 and extends into chamber 12. Located in the transverse bore 15 is a generally cylindrical valve plug 16 which is rotatable (by means of a tab 17 locating externally of the spray head body 4) between a first, "open" position in which a channel 18 in plug 16 allows communication between the passageways 13 and 14 and a second, closed position in which such communication is prevented.

A further feature of the spray head 4 relates to the outlet bore 8. As represented by the "dashed-lines" shown along the outlet bore 8 (see FIG. 3), the interior surface of this bore is formed along its length and around its circumference with an aerating surface, to which further reference is made below.

Hose connector 6 is intended to connect the spray head 4 directly to a source of mains water without intermediate pressurisation equipment by means of a hose (not shown), the downstream end of which is a secure fit onto the connector 6. Within the spray head 5 (and to be described in more detail below) is the chamber 12. When valve plug 16 is in its open position, water can be introduced into the spray head 5 through hose connector 6 and issues into the chamber 12 as a fine jet that passes just over the outlet of passageway 14. This jet causes surfactant composition in container 2 to be drawn upwardly by means of a venturi effect into the chamber 12 where it is mixed with the water, the resultant mixture then being passed along the outlet bore 8. As mentioned above, the inner surface of the bore 8 is configured along its length and around its circumference to provide an aerating surface. This surface serves to introduce air into the water/detergent mixture on its passage from the chamber region 12*d* to the outlet 7 to result in the production of a stream of snow foam 19 issuing from the head 4.

Figure 4:
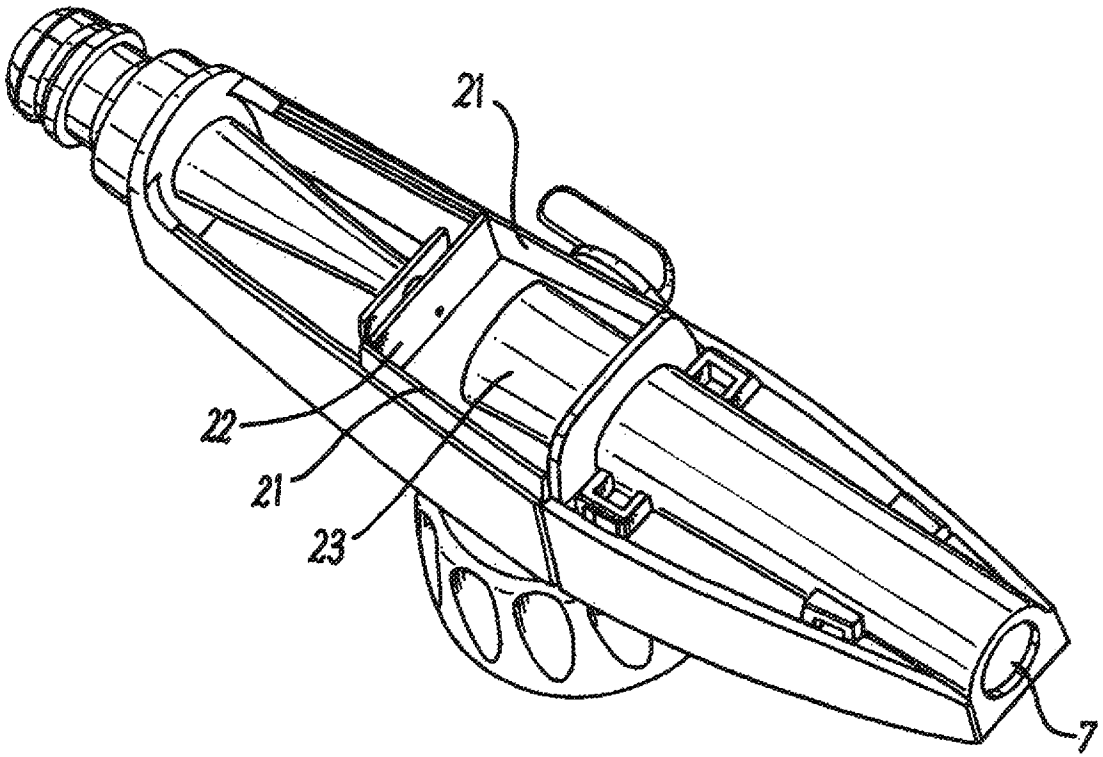
FIG. 4 is a part cut-away view of the spray head shown in FIG. 2, the upper portion of the spray head being removed and the view being generally from above the spray head.
Figure 5:
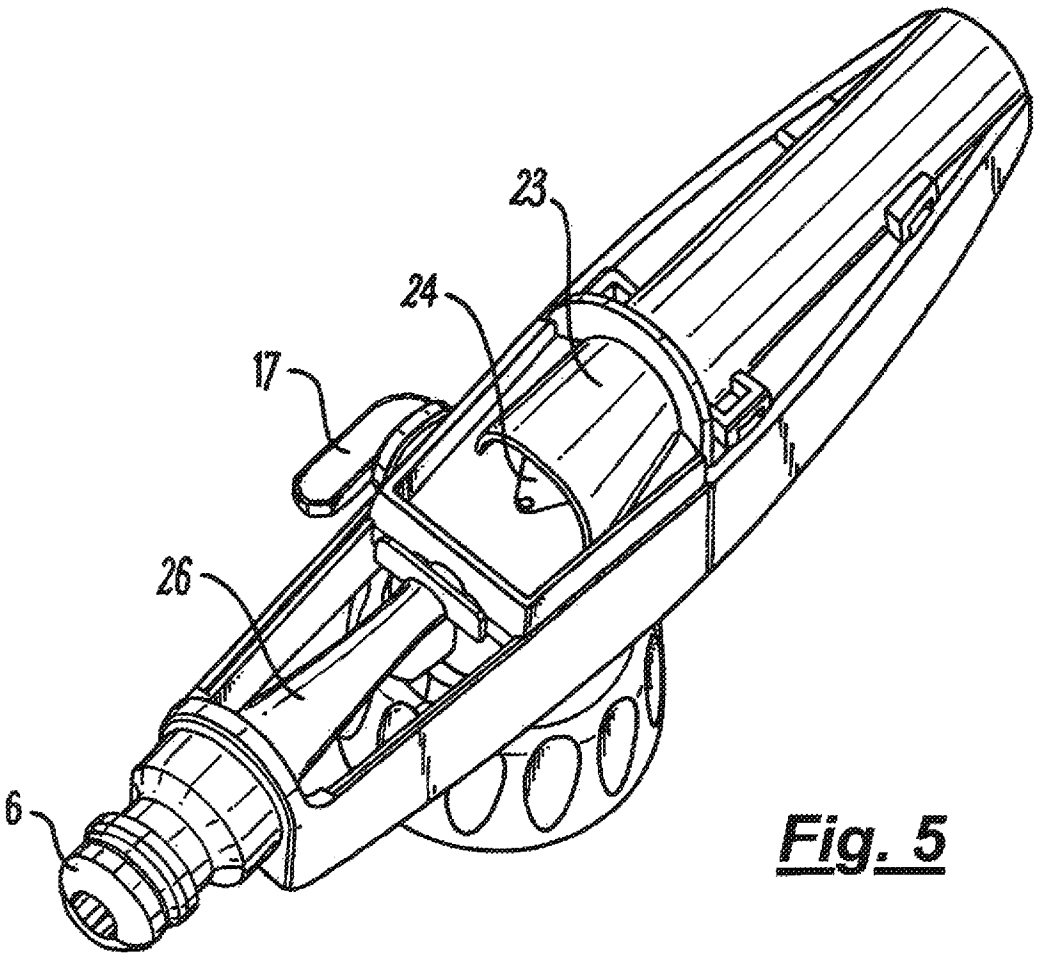
FIG. 5 is a view of the spray head illustrated in FIG. 4 but from the inlet end thereof.
Figure 6:
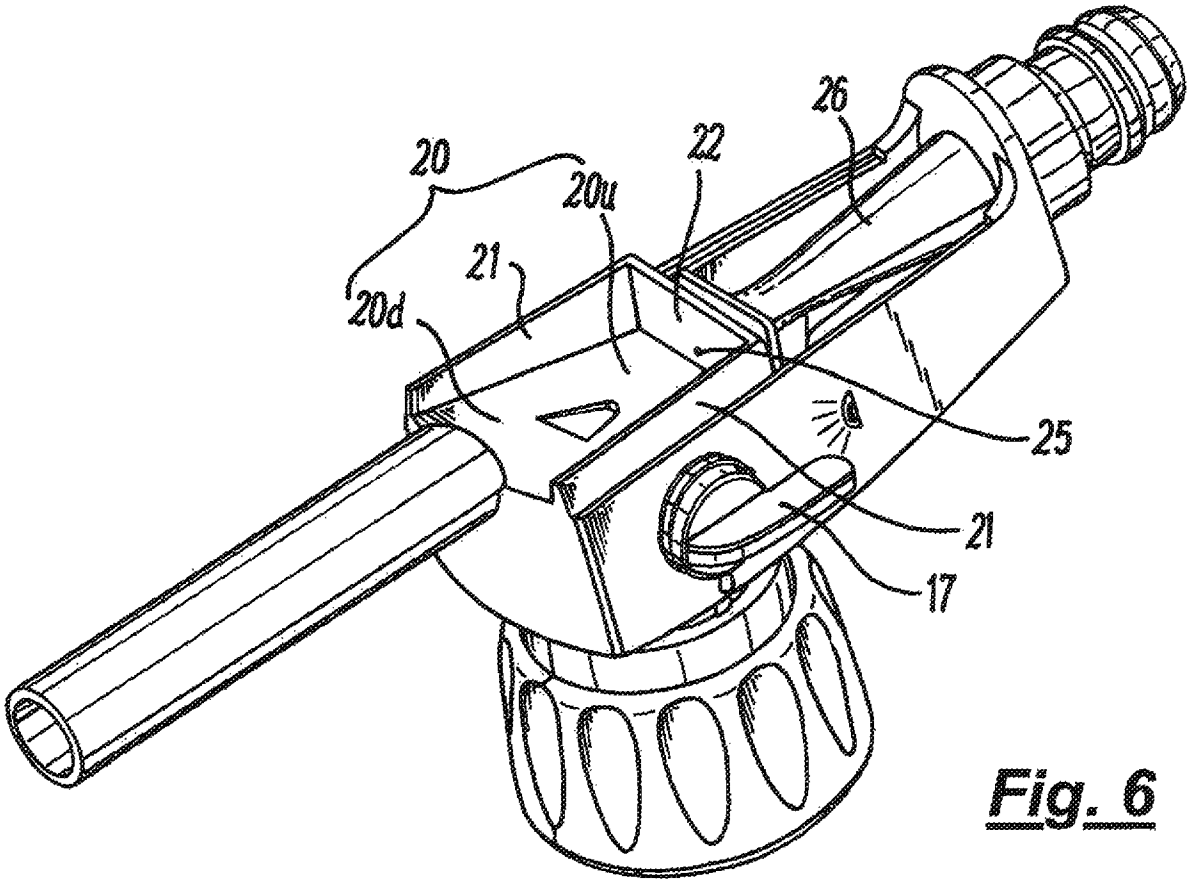
FIG. 6 is a view of the spray head shown in FIG. 4 but generally from the outlet end thereof and with a further interior component of the spray head removed for the purposes of clarity.

Reference is now made to the cut-away views of FIGS. 4 to 6 for a detailed understanding of the manner in which (when valve plug 16 is in the open position) both water and detergent composition are introduced into the chamber 12 to produce snow foam. In the case of FIGS. 4 and 5, the views represent the spray head 4 with a top body casing portion 5*a* (represented in FIGS. 1 and 2) removed. In the case of FIG. 6, the top body casing portion 5*a* is also removed together (for the purposes of additional clarity) with the tunnel element 23 to which reference is made below.

Within spray head 4 is the chamber which, in its entirety, is designated herein by reference numeral 12 but which, for convenience, is defined as comprising upstream and downstream portions 12*u* and 12*d* respectively. Common to the chamber regions 12*u* and 12*d* is a floor 20 which (again for convenience of terminology) is referenced as having a portion 20*u* in the upstream region 12*u* of the chamber and a portion 20*d* in the downstream region 12*d* of the chamber (see particularly FIG. 6). Additional to the floor region 20*u*, the upstream chamber 12*u* is defined by two side walls 21, a rectangular upstream wall 22 that extends longitudinally between the side walls 21 with its lower longitudinal edge along the floor 20*u*, and the upper casing portion 5*a* of body 5 (not seen in FIGS. 3-5), there being a gap between the upper longitudinal edge of wall 22 and the under surface of cover 5*a* provides the air inlet for the chamber 12. The downstream chamber region 12*d* is formed by a tunnel element 23 which arches over the floor region 20*d*. The chamber region 12*d* as defined by tunnel element 23 and floor region 20*d* and is generally semicircular along its length but of decreasing diameter in going from its upstream end (at the interface of chamber regions 12*u* and 12*d*) to its downstream end where it opens into the outlet bore 8.

As most clearly seen in FIG. 6 (from which the tunnel element 23 has been removed for the purposes of clarity), floor 20 inclines upwardly from its upstream end at the wall 22 to its downstream end at its junction with the upstream end of outlet bore 8 so that only a semicircular region of this upstream end (of bore 8) communicates with the chamber region 12*d* (see also FIG. 3). In more detail, and as can be seen from FIG. 3, there is a shoulder 40 at the upstream end of the bore 8 which effectively provides an abrupt, step-like transition for the increase in cross-section in going from the downstream end of the chamber region 12*d* to the upstream end of the bore 8.

Formed in the floor 20*d* in the region of the mouth of the tunnel 23 is a triangular recess 24 with two sides that diverge from an apex of the recess, at which the outlet of passageway 14 is provided (see FIG. 6), towards the interior sides of the tunnel element 23. The function of this triangular recess will be clear from the description given below.

An orifice 25 (see FIG. 6) is provided through the upstream wall 22 of chamber 12 and serves as a water inlet for this chamber. Supply of water to and through the orifice 25 from hose connector 6 is via a tube 26 that converges going in a direction from hose connector 6 to orifice 25. Tube 26 serves to increase the velocity of water entering the head through hose connector 6 so that the water issues as a fast moving, fine jet 27 (see FIG. 3) from orifice 25 directed towards the chamber region 12*d*. The position of orifice 25 in wall 24 is such that the a horizontal line extending through the centre of the orifice 25 towards the outlet bore 8 meets the lower surface of the chamber at a point downstream of the outlet of passageway 14. As such, the fine jet 27 passes slightly above the outlet of passageway 14 and strikes the downstream floor region 20*d* at or beyond the downstream edge of triangular recess 24.

Provided beneath the tube 26 is an aperture 28 in the outer casing of the spray head 4 whereby the interior of the chamber 12 communicates with the ambient atmosphere via the aperture 28 and the aforementioned gap between the upper longitudinal edge of wall 22 and the undersurface of casing portion 5*a*.

Figure 7:
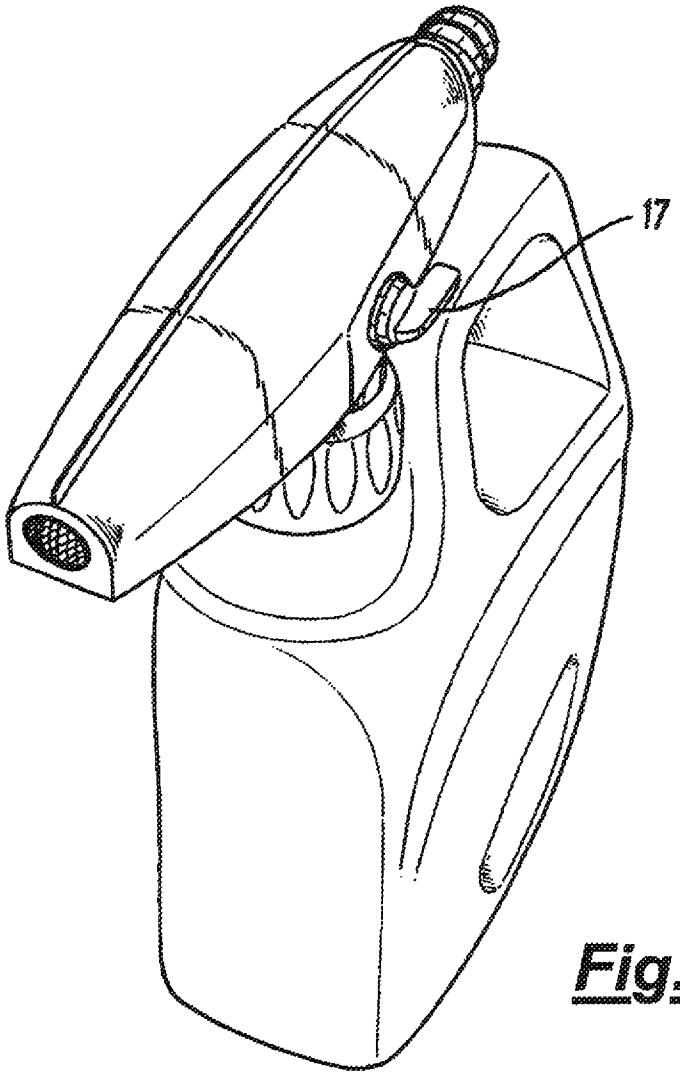
FIG. 7 is a view of the spray device as seen generally in the direction of arrow A in FIG. 1.
Figure 8:
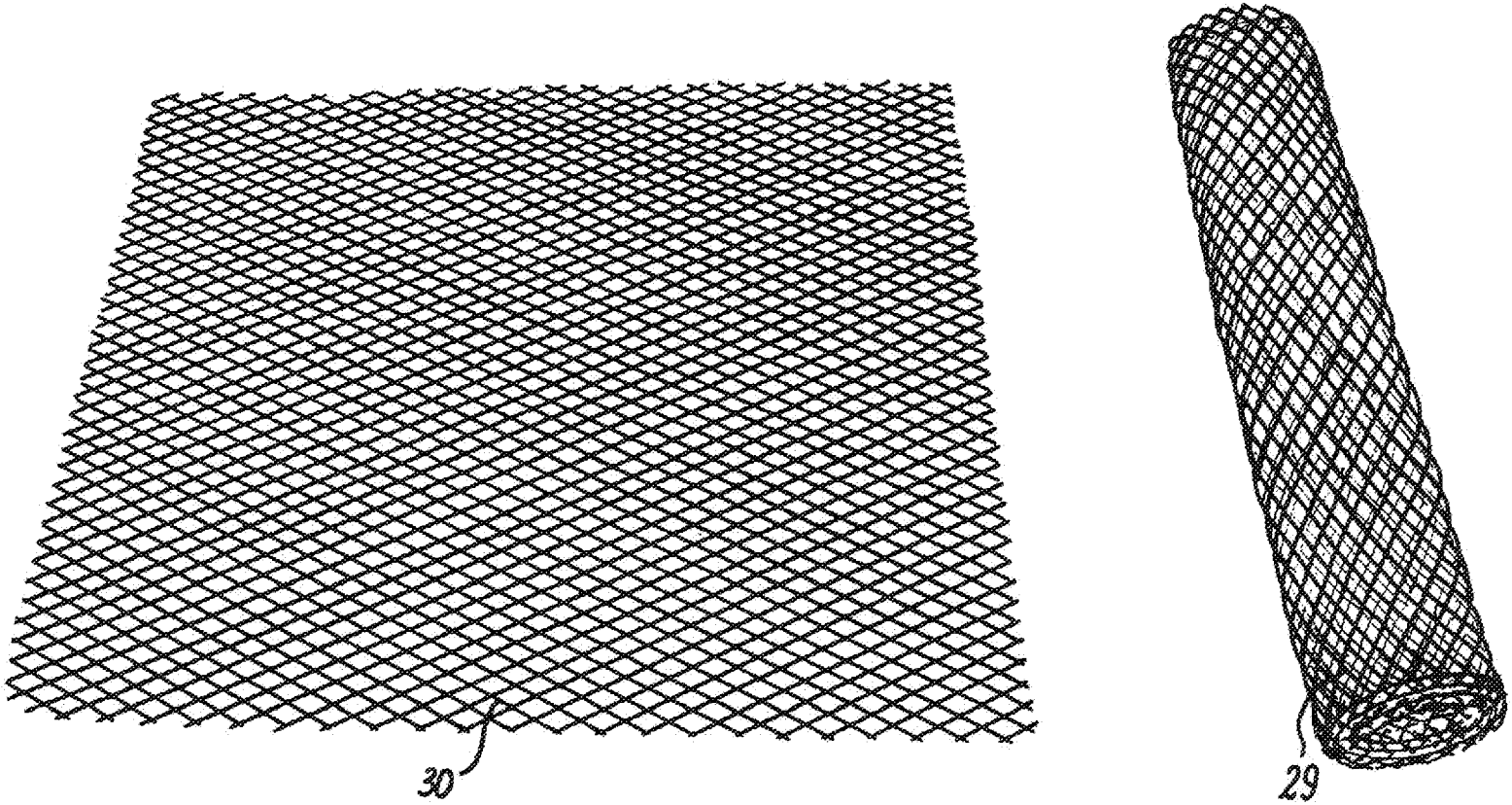
FIG. 8 shows details of mesh structures.

As indicated above, the outlet bore 8 of spray head 4 is of circular cross-section and is formed around its circumference and along its length with an aeration surface for the purpose of aerating a mixture of water and detergent produced within the chamber 12. This aeration surface in the embodiment illustrated in FIGS. 4 to 6 is provided by a tubular mesh structure 29 (see FIG. 7) which has an outer diameter just marginally less than the inner diameter of bore 8, whereby the tubular mesh structure 29 may be inserted into and along the bore. The tubular mesh structure 29 is retained within the bore 8 by any suitable means (not shown). The tubular mesh structure may be of metal and may have diamond mesh openings. Conveniently the tubular mesh structure 29 is formed from a rectangular sheet 30 of expanded metal such as that illustrated at the left hand side of FIG. 8. Tubular mesh structure 29 is a double-walled, spirally wound structure and may easily be formed by rolling the mesh sheet 30 into the required configuration. Purely by way of example, sheet 30 may have dimensions of 82 mm by 66 mm and be rolled into a double-walled cylinder having a length of 66 mm and an external diameter of 13.6 mm. The bore 8 is correspondingly sized to include a mesh structure of these dimensions.

To use the spray device 1 to produce snow foam, the container 2 is charged with a solution of a detergent (capable of generating snow foam), a hose (not shown) connected to a mains water supply is located on the connector 6 and the valve plug 16 is located in its open position. The detergent solution charged into the container 2 is aqueous and preferably comprises olefin sulfonates as the foaming component and may also incorporate ancillary ingredients such as fragrances, dyes, biocides and corrosion inhibitors. The olefin sulfonates will generally be present in an amount of about 5-10%, e.g. about 8%, by weight and will usually be used in the form of sodium salts.

Water entering hose connector 6 issues as the aforementioned fine jet 27 from the orifice 25 in wall 22. As indicated previously, this jet 27 passes closely over the top of passageway 14 and in doing so creates a venturi effect whereby a low pressure region is generated at the outlet of passageway 14 causing detergent solution to be drawn upwardly through the dip tube arrangement 10 and issue upwardly out of passageway 14. During this process, air is drawn into the chamber 12 via the aperture 28 and the gap between the upper surface of the wall 22 and the undersurface of cover element 5*a*. The detergent solution and water mix and are caused by the triangular recess 24 in the floor 20*d* to form a diverging mixture that "fans-out" going downstream along the tunnel 23. This mixture then enters the outlet bore 8. In going from the chamber region 12*d* into the outlet bore 8, the detergent/water mixture undergoes an abrupt expansion since the cross-section of the downstream end of chamber 12*d* is less than that of the outlet bore 8, there being the shoulder 40 which provides for the abrupt step-like expansion. Within the outlet bore 8, the detergent water mixture is converted to a thick, foamy mixture (i.e. snow foam) which issues as a stream from the outlet 7 of the spray head 4. The thick foamy mixture is generated in the outlet bore 8 by a combination of foamed detergent that fills the outlet bore 8 being forced along the bore by the production of more foaming detergent and the interruption of the flow by the mesh structure 30 as compared to the flow that would occur if the outlet bore 8 were smooth-walled. The high surface area of the expanded metal surface (mesh) allows for increased contact with the detergent/water/air mixture. The arrangement creates a rich foam (snow foam) without restricting the distance over which the dispensed snow foam is projected.

Therefore, as described more fully above, the spray device 1 is able to generate a stream of snow foam purely from mains pressure water without the need for pressurising equipment. The spray device is therefore a cost-effective device for snow foam generation for domestic use.

In use for cleaning a car or other vehicle, the outlet 7 of the device is, of course, directed at the vehicle body work so that the snow foam is applied thereto. Once the snow foam has been applied, the valve plug 16 can be rotated (using the tab 17) so as to close-off the supply of detergent to the chamber 12. As such, a water (rather than foam) stream now issues from the outlet 7 and may be used to rinse the vehicle body work as required.

We have found that optimum generation of snow foam is achieved with the double-walled mesh structure 30 but a number of variations are possible. Thus, for example, a single-walled mesh structure may be used or one with three or (possibly) more walls. An alternative to a mesh structure, another form of aeration surface may be provided for the outlet bore 8. Possibilities include particulate (e.g., abrasive) material embedded in the inner wall of the outlet bore and projecting into the bore thereof. Further means for providing an aeration surface for the bore 8 include synthetic foams, metal foams, wire and wire wool.

Further features of the illustrated embodiment relate to packaging and assembly of the spray device 1.

It will be noted from FIG. 1, that the downstream end of the body 5 of spray head 4 projects somewhat beyond the container 2. As such, if the spray device 1 were to be supplied to the end user packaged in an assembled condition then a box (or other package) would be required that accommodates the portion of spray head 4 that projects beyond the container 2. Given that the package was cuboid, there would be significant "free-volume" (i.e., space not occupied by the spray device to itself) within the package, which is a disadvantage not only in terms of amount of packaging material required but also in terms of the number of packages that could be accommodated in, say, a standard shipping container. To avoid this disadvantage, one side of the container 2 is formed with a generally T-shaped recess 31 (see FIG. 1) in which the spray head 4 may be accommodated.

A further feature facilitating packaging and assembly of the spray device 1 is that the dip tube arrangement 10 is formed in two parts, namely an upper dip tube section 32 and a lower dip tube section 33 which (in the assembled spray device) both extend into the aperture in bung 11 (see FIG. 1). Upper dip tube 32 is fixed into the spray head 4. This head may be removed from the container 2 with the dip tube 32 in place in the spray head 4, it being noted that the lower end of dip tube 32 does not extend below the boss 9.

For the purposes of packaging the assembly, the spray head 4 (incorporating dip tube 32) is positioned in the recess 31 in the face of container 2. As such, a considerably lower volume of packaging is required than would be the case if the spray device 1 were to be supplied with the spray head 4 mounted in position on container 2.

Additionally, the container 1 is supplied with bung 11 in position in the neck 3 of container 2, the dip tube 33 having its upper end located in the aperture of the bung 11.

When it is desired to use the device, the bung 11 with attached dip tube 33 may be removed from the neck 3 of container 2 which can then be filled with the aforementioned detergent solution. Bung 11 (with attached dip tube 33) may now be located back in the neck of the container. Subsequently, the spray head 4 (with attached dip tube 32) is fitted by positioning the lower end of dip tube 32 into the aperture of bung 11 and rotating the boss 9 relative to the neck 3 to locate the spray head 4 in its operative position.

The invention claimed is:

1. A foam generating spray head comprising:

a body, a chamber formed in the body and being in communication with the atmosphere, an elongate foam generating outlet bore formed in the body and extending in a first direction from the chamber to an outlet of the body, a detergent inlet aperture in a surface of the chamber, said inlet aperture being for communication with a reservoir of detergent, a water inlet for the chamber and being configured to direct a jet of water over said detergent inlet aperture and into the chamber in said first direction towards the foam generating chamber, said water inlet and said detergent inlet aperture being co-configured so that passage of said water jet over said inlet aperture causes detergent from the reservoir to be drawn into the mixing chamber, and wherein an inner surface of the foam generating outlet bore is formed as an aerating surface, wherein the bore remains open along its length between the aerating surface and the centerline of the bore, a downstream region of the chamber forms a junction with an upstream end of the outlet bore, the surface of the chamber in which the detergent inlet aperture is provided has a configuration to cause a diverging flow of detergent into the chamber towards the foam generating outlet bore the surface of the chamber in which said detergent inlet aperture is provided is inclined such that a notional line drawn through the center of the water inlet and extending in the first direction meets the surface of the chamber in which the detergent inlet aperture is provided at a point downstream of said aperture, and at its upstream end the outlet bore is of increased cross-sectional area as compared to the downstream region of the chamber with which it communicates, said increased cross-sectional area being provided by a shoulder at the upstream end of the outlet bore at its junction with the downstream region of the chamber and said shoulder being configured to provide an abrupt step-like transition in going from the chamber to the foam generating outlet bore.

2. A spray device comprising a container for holding detergent, a spray head for mounting on the container, and a liquid supply arrangement for transferring liquid from the container to the spray head, wherein the spray head comprises:

a body, a chamber formed in the body and being in communication with the atmosphere, an elongate foam generating outlet bore formed in the body and extending in a first direction from the chamber to an outlet of the body, a detergent inlet aperture in a surface of the chamber, said inlet aperture communicating with the liquid supply arrangement and being for communication with the interior of the container, a water inlet for the chamber and being configured to direct a jet of water over said detergent inlet aperture and into the chamber in said first direction towards the foam generating outlet bore, said water inlet and said detergent inlet aperture being co-configured so that passage of said water jet over said inlet aperture causes detergent from the container to be drawn into the chamber, and wherein an inner surface of the foam generating outlet bore is formed as an aerating surface, wherein the bore remains open along its length between the aerating surface and the centerline of the bore, a downstream region of the chamber forms a junction with an upstream end of the outlet bore, the surface of the chamber in which the detergent inlet aperture is provided has a configuration to cause a diverging flow of detergent into the chamber towards the foam generating outlet bore, the surface of the chamber in which said detergent inlet aperture is provided is inclined such that a notional line drawn through the centre of the water inlet and extending in the first direction meets the inclined surface of the chamber in which the detergent inlet aperture is provided at a point downstream of said aperture, and at its upstream end the outlet bore is of increased cross-sectional area as compared to the downstream region of the chamber with which it communicates, said increased cross-sectional area being provided by a shoulder at the upstream end of the outlet bore at its junction with the downstream region of the chamber and said shoulder being configured to provide an abrupt step-like transition in going from the chamber to the foam generating outlet bore.

3. A spray device as claimed in claim 2 wherein the foam generating outlet bore is lined at least partially with a mesh structure which provides said aerating surface.

4. A spray device as claimed in claim 3 wherein the foam generating outlet bore is lined along its length and around its periphery with said mesh structure.

5. A spray device as claimed in claim 4 wherein the mesh structure is tubular, preferably cylindrical.

6. A spray device as claimed in claim 3 wherein the mesh structure comprises two or more layers of mesh.

7. A spray device as claimed in claim 6 wherein the mesh is spirally wound to provide said mesh structure.

8. A spray device as claimed in claim 3 wherein the mesh structure is of expanded metal.

9. A spray device as claimed in claim 2 wherein the aerating surface of the foam generating outlet bore comprises particulate material projecting from the surface.

10. A spray device as claimed in claim 9 wherein the aerating surface is an abrasive surface.

11. A spray device as claimed in claim 2 wherein the aerating surface comprises synthetic foam, metal foam, wire or wire wool.

12. A spray device as claimed in claim 2 wherein the surface of the chamber in which the detergent inlet aperture is provided has the configuration to cause a diverging flow of detergent into the chamber towards the foam generating outlet bore, and wherein said configuration comprises a recess having two sides diverging from the detergent inlet aperture towards said foam generating outlet bore.

13. A spray device as claimed in claim 2 wherein the surface of the chamber in which the detergent inlet aperture is provided is a basal surface of the chamber.

14. A spray device as claimed in claim 2 wherein the body of the spray head has a connector for a hose and said connector is in communication with the water inlet to the chamber via a converging passageway.

15. A spray device as claimed in claim 2 wherein the liquid supply arrangement is a dip tube arrangement.

16. A spray device as claimed in claim 15 wherein the outlet of the container accommodates a bung having a bore and the dip tube arrangement comprises a first dip tube extending from the bore downwardly into the container and a second dip tube extending between the bore and the spray head.

17. A spray device as claimed in claim 16 wherein the spray head is fixed to the second dip tube.

18. A spray device as claimed in claim 2 wherein the container has a side wall formed with a recess in which the spray head may be located.

19. A spray device as claimed in claim 2 wherein the container has a side formed with a recess capable of accommodating the spray head.

20. A package comprising packaging material and a spray device as claimed in claim 18 in said package with the spray head being located in said recess.

21. A spray device as claimed in claim 2 wherein the spray head is mounted on the container.

* * * * *